US010239683B2

(12) United States Patent
Umentum et al.

(10) Patent No.: US 10,239,683 B2
(45) Date of Patent: Mar. 26, 2019

(54) SYSTEM AND METHOD FOR PROTECTIVE EYEWEAR DISPENSING

(71) Applicant: TIDI Products, LLC, Neenah, WI (US)

(72) Inventors: Katie Umentum, De Pere, WI (US); Adam Poppert, Milwaukee, WI (US); Kurt Miller, Neenah, WI (US); Vincent E. Portelli, Oshkosh, WI (US); Rob Sweitzer, Wauwatosa, WI (US); Brad Binder, Oshkosh, WI (US); William James Evans, San Francisco, CA (US); Matt Presta, San Mateo, CA (US)

(73) Assignee: TIDI Products, LLC, Neenah, WI (US)

( * ) Notice: Subject to any disclaimer, the term of this patent is extended or adjusted under 35 U.S.C. 154(b) by 405 days.

(21) Appl. No.: 14/209,567

(22) Filed: Mar. 13, 2014

(65) Prior Publication Data

US 2015/0191296 A1 Jul. 9, 2015

Related U.S. Application Data

(60) Provisional application No. 61/779,871, filed on Mar. 13, 2013.

(51) Int. Cl.
*B65D 83/08* (2006.01)

(52) U.S. Cl.
CPC ..... *B65D 83/0805* (2013.01)

(58) Field of Classification Search
CPC ..... B65D 5/725; B65D 5/0245; B65D 5/4204
See application file for complete search history.

(56) References Cited

U.S. PATENT DOCUMENTS 5,615,767 A * 4/1997 Eull ..... B65D 5/5023 206/278
5,836,478 A * 11/1998 Weiss ..... B65D 5/725 221/155
8,136,697 B2 * 3/2012 Hackney ..... A47F 1/08 221/303
8,494,507 B1 * 7/2013 Tedesco ..... A61F 4/00 434/112
2008/0302864 A1 * 12/2008 Smith ..... B65D 71/36 229/122.1

(Continued)

*Primary Examiner* — Gene O Crawford
*Assistant Examiner* — Kelvin L Randall, Jr.
(74) *Attorney, Agent, or Firm* — Boyle Fredrickson, S.C.

(57) ABSTRACT

A system and method for improved dispensing for protective eyewear components, including frames, lenses and assembled protective eyewear glasses, is described. A housing stores and dispenses the eyewear components through an opening. In an embodiment, the eyewear components may be detachably connected together, such as via perforations, and/or may be coiled in a roll or stacked in serpentine configuration within the housing. Also, in one embodiment, a lever of other mechanism may be coupled to the housing to provide advantageous operations of the dispenser, including assembling and/or dispensing the eyewear components. Accordingly, the system and method provides advantages in that rapid and hygienic dispensing of protective eyewear components may be provided.

13 Claims, 16 Drawing Sheets

(56) References Cited

U.S. PATENT DOCUMENTS

| | | | | |
|---|---|---|---|---|
| 2009/0014460 | A1* | 1/2009 | Kobus, II | G06Q 20/127 221/135 |
| 2012/0272437 | A1* | 11/2012 | Grad | A61F 9/025 2/431 |
| 2013/0146501 | A1* | 6/2013 | Zusmanis | B65F 1/06 206/525 |
| 2013/0206787 | A1* | 8/2013 | Shiell | F42B 39/002 221/279 |
| 2014/0319204 | A1* | 10/2014 | Schultz | B65D 83/0876 229/122 |
| 2014/0319205 | A1* | 10/2014 | Schultz | B65D 5/725 229/122.1 |

* cited by examiner

VENDING MACHINE FOR PROTECTIVE COMPONENTS

FRAMELESS EYESHIELD DISPENSER

SYSTEM AND METHOD FOR PROTECTIVE EYEWEAR DISPENSING

CROSS-REFERENCE(S) TO RELATED APPLICATION(S)

This application claims a benefit of priority under 35 USC § 119 based on U.S. Provisional Patent Application No. 61/779,871, filed Mar. 13, 2013, the entire contents of which are hereby expressly incorporated by reference into the present application.

BACKGROUND OF THE INVENTION

1. Field of the Invention

The present invention relates in general to the field of eye protection. More particularly, the present invention relates to different types of eye shields, frames to support the eye shield, and dispensing devices for the frames and eye shields.

2. Discussion of the Related Art

U.S. Pat. No. 5,440,760 discloses a disposable face shield. The face shield protects the wearer against airborne particles and droplets that potentially contain pathogens. The face shield includes a plastic shield with a cord attached to a crescent-shaped foam member for securing the shield about the wearer's face. The foam member is designed to conform to the wearer's forehead.

One particular problem of the above-mentioned face shield is that when a plurality of face shields is stored, they occupy a great deal of storage space. Furthermore, should the wearer desire an eye shield in addition to a face shield, or instead of a face shield, even more storage space must be used. The pre-assembly of face shields or of eye shields also adds to the cost of the protective wear.

An added disadvantage is the dispensing process of a typical face shield or eye shield. Normally, these types of products are stored in boxes or bags, which are stored in cabinetry. In a healthcare facility, hand sanitation is very critical to mitigate the spread of pathogens. Thus, the handling of packaging, cabinet doorknobs, and drawers introduces opportunities for a person's hands to contact a pathogen.

Therefore, what is needed is a convenient way to store and dispense eye protection such as face shields and eye shields. What is also needed is a storage and dispensing device that minimizes contact with a person's hands on any objects.

SUMMARY AND OBJECTS OF THE INVENTION

By way of summary, the present invention is directed to improved dispensers for protective eyewear components for use preferably in a doctor's or dentist's office. The eyewear components preferably include frames, lenses and/or assembled protective eyewear glasses. A housing stores and dispenses the eyewear components through an opening. In an embodiment, the eyewear components may be detachably connected together, such as via perforations, and/or may be coiled in a roll or stacked in serpentine configuration within the housing. An individual eyewear component may be at least partially exposed via the opening. Detachable removal of the exposed individual eyewear component may result in a next eyewear component being at least partially exposed.

Also, in one embodiment, a lever or other mechanism may be coupled to the housing to provide advantageous operations of the dispenser. The lever or other mechanism may provide mechanical and/or electronic control for a variety of actions, including assembling and/or dispensing the protective eyewear components. An additional embodiment may provide, for example, one or more of: efficient storage of eyewear components by unfolding during or after dispensing, assembly of eyewear components simultaneous with dispensing, exposing only a portion of eyewear components during assembly and dispensing, rolling eyewear components for efficiency and portability, dispensing information or identification tags simultaneous with dispensing eyewear components, dispensing of eyewear components in containers or bags, which may be held detachably together; vending eyewear components in a machine; hands-free dispensing of eyewear components; scanning eyewear components and/or users simultaneous with dispensing; and/or electrically displaying useful information associated with eyewear components.

An effect of the present invention is to provide efficient, cost-effective solutions for rapid and hygienic dispensing of protective eyewear. One or more features of the various embodiments disclosed may be advantageously combined with other features in other embodiments.

In accordance with a first aspect of the invention, these objects are achieved by providing an apparatus comprising: a plurality of protective eyewear lenses held detachably together; a housing having a front panel and sidewalls defining an interior volume configured to hold the plurality of protective eyewear lenses; an opening in the front panel; individual protective eyewear lenses from among the plurality of protective eyewear lenses exposed by the opening in the front panel; and next individual protective eyewear lenses from among the plurality of protective eyewear lenses exposed by the opening in the front panel upon detachably removing the individual protective eyewear lenses.

In accordance with a second aspect of the invention, these objects are achieved by providing an apparatus comprising: a plurality of protective eyewear components; a housing having a front panel and sidewalls defining an interior volume configured to hold the plurality of protective eyewear components; an opening in the front panel; an individual protective eyewear component from among the plurality of protective eyewear components; and a lever or other mechanism coupled to the housing and in communication with the plurality of protective eyewear components; wherein movement of the lever moves the plurality of protective eyewear components to expose the individual protective eyewear component via the opening.

In accordance with a third aspect of the invention, these objects are achieved by providing a method comprising: holding a plurality of protective eyewear lenses detachably together; storing the plurality of protective eyewear lenses in a housing having a front panel and sidewalls defining an interior volume; exposing via an opening in the front panel individual protective eyewear lenses from among the plurality of protective eyewear lenses; and detachably removing the individual protective eyewear lenses to expose next individual protective eyewear lenses from among the plurality of protective eyewear lenses.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

DESCRIPTION OF EMBODIMENTS

1. Resume a. Eye Shields

Figure 1:
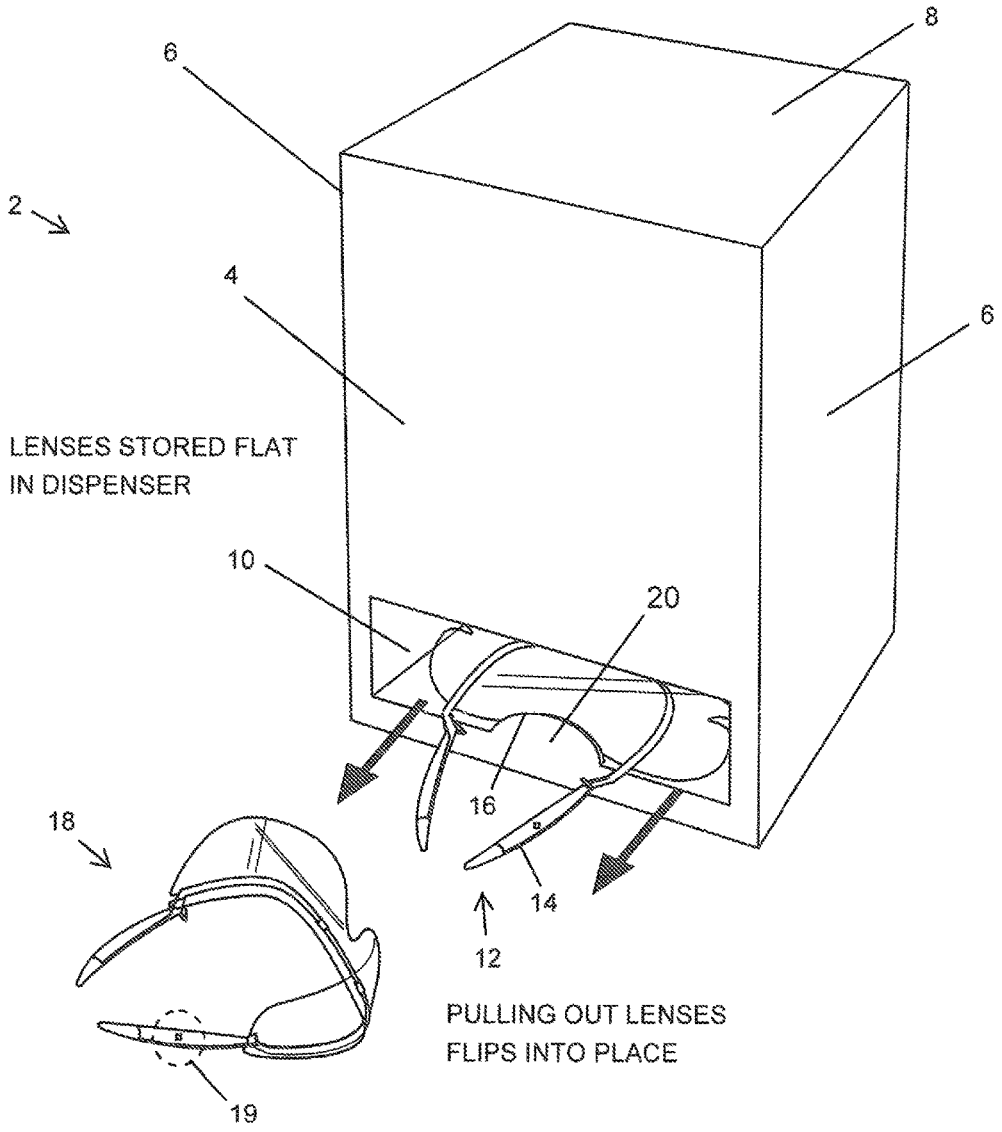
FIG. 1 illustrates a perspective view of a dispenser for protective eyewear in which eyewear may be stored in a container while in a flat position in accordance with an embodiment of the present invention.

In general, the eye protection disclosed herein, and disclosed in co-pending U.S. patent application Ser. No. 14/209,847, titled "Eye Protection," to the assignee hereof, the contents of which is hereby expressly incorporated by reference in its entirety, has a number of basic features. For example, some of these features are discussed in greater detail below under the heading Concept 1, 2, and 3. However, it should be appreciated that these features are not limited to those listed and in fact may be combined into a variety of new and unique embodiments. As will be seen, these features also impact how the disclosed eyewear is dispensed.

Concept 1:

a. A common frame that will work with both the eye shields and full face shields.
b. The lenses in this concept will have a common top portion and attachment method, but a different length and bottom shape.
c. The geometry of the frame is such that a support for the nose bridge is not needed when used in the eye shield variant or when used with eyeglasses.
d. When used with full face shield lens, a nose bridge support achieves the stand-off required to clear the nose.
e. All elements are modular.
f. A dispensing system that allows for bulk storage of lenses in a roll, z-fold, or just stacked, and has bulk frame storage also, plus additional storage for items like the nose bridge supports or other facial protection products like masks with visors, or plain masks. These may be replenished by means of a cartridge system designed in such a way that only TIDI cartridges can be inserted.
g. A manual mechanism, e.g., level, dial, button, that advances the next lens into place and positions it for frame insertion. The lens is held by the dispenser in such a way that it will engage the frame as it is inserted, both on the front and side attachment points, eliminating the need to handle the lenses (keeping them clean). Ideally, it would allow for one-handed operation. An optional electronic variant would do the same thing, triggered like the automatic towel dispensers in restrooms. The critical element here is the way the dispenser is shaped and how it holds the lens. Also important is how the next lens is advanced into position.

h. The dispenser will accommodate both the eye shield lenses, and the lenses for the full face shield, the latter having a larger holding area.

Concept 2:

a. Venting to eliminate fog while preventing fluid ingress.

b. This is depicted in the drawings, but the essential element is that the lens material itself functions together with the frame to create the system.

c. Special lens geometry that allows for the eye shield variant to rest against the cheek by angling back toward the face, while the full face shield version angles outward to clear the nose. This is done by changing the angle of the area of the lens that attaches to the frame.

d. The dispenser shown in this concept is simpler than Concept 1. Here the frame is inserted but only grabs the top portion of the lens. When the frame is rotated down 90 degrees, it locks the lens into place only on the front/top. After it is pulled out of the dispenser, the user has to manually attach the sides.

Concept 3:

e. The foam headband comes in two profiles, a thin one for use with eye shields, and a thicker one to achieve the stand-off required to clear the nose when used with full face shields. All other design elements are identical, allowing the same elastic strap to be used with either.

f. This dispensing system is the simplest, the user pulls out a lens on a flat supporting surface in order to snap the band into place and they are done.

g. Referred to as "frameless" eyewear.

Again, it should be noted that all the above listed elements could be "mixed and matched".

The inventors have solicited user feedback on the invention. A brief summary of that follows.

Note anti-fog film lenses ranks #1 in the raw listing and is associated with things like ventilation, heat buildup, proximity to skin, geometry etc. These and other factors are included in the design ideas.

b. Suggested List of Brainstorming Topics

The topics are framed as "questions" that the user group considered.

Topic 1:

Based on prioritized Customer Responses (CRs): 1 & 2 works with glasses+anti-glare "How can we improve our product in a way that affects either or both attributes of "works with glasses" and "anti-glare"?

Topic 2:

Based on prioritized CRs: #3 & 4 comfort+over splash guard

"How can we improve the comfort of our facial protection products and, if possible, also improve the level of splash prevention (over, under, or around the protection)"

Topic 3:

Based on prioritized CRs: #10 reduced cost of use thru more than one lens per frame–a topic around trying to make Flipease® have the interchangeability of Resposables® with the convenience of storage and distribution of Flipease was considered. AND, then having a topic around functional packaging was later considered.

"How can we create an eyewear or facial protection product that has the ability to have lenses reused or not, with compact storage of the product, and able to be quickly deployed"?

Topic 4:

Based on prioritized CRs: #5 inexpensive per use

"How could we reduce the cost of our product"?

Topic 5:

Based on prioritized CRs: #6 more sustainable than past product

"How can we make our product more sustainable"? (Also thought of by customers as "green", "eco", "lower carbon footprint", etc.)

Topic 6:

Based on prioritized CRs: 7 & 8 packaging dispensing point of use/convenience+institutional tracking of use "How can we package our product to be more convenient to dispense"? OK to create ideas that may or may not allow institutional tracking of use integrated with the packaging and also OK to create ideas just to deal with institutional tracking of use without dispensing.

Topic 7:

Based on prioritized CRs: #9 ease and speed of deployment

"How can we make any of our facial protection products easier and/or quicker to deploy"?

Topic 8:

c. Face Protection System

"Considering facial protection as a range of products:

Eyewear

Face shield

Mask+eyewear

How can we create a system with as few parts as possible that has as many good attributes as possible from our CRs—e.g., comfort and anti-glare/anti-fog, good ventilation, less hot etc."?

2. Detailed Description of the Preferred Embodiments

In describing the preferred embodiment of the invention, which is illustrated in the drawings, specific terminology will be resorted to for the sake of clarity. However, it is not intended that the invention be limited to the specific terms so selected and it is to be understood that each specific term includes all technical equivalents, which operate in a similar manner to accomplish a similar purpose. For example, the words "connected", "attached", or terms similar thereto are often used. They are not limited to direct connection but include connection through other elements where such connection is recognized as being equivalent by those skilled in the art.

Specific embodiments of the present invention will now be further described by the following, non-limiting examples which will serve to illustrate various features of significance. The examples are intended merely to facilitate an understanding of ways in which the present invention may be practiced and to further enable those of skill in the art to practice the present invention. Accordingly, the examples should not be construed as limiting the scope of the present invention. Note the various inventive elements are shown in several views.

Beginning with FIG. 1, a perspective view of a dispenser 2 for protective eyewear is provided in accordance with an embodiment of the present invention. The dispenser 2 includes a housing having a front panel 4 and sidewalls 6 defining an interior volume configured to hold a plurality of protective eyewear, such as frames, lenses or both. The dispenser 2 also includes an opening 10 in the front panel 4. The opening 10 may be advantageously positioned in a lower portion of the front panel 4 to take advantage of gravity for feeding the protective eyewear downward. Accordingly, the dispenser 2 stores the plurality of protective eyewear lenses, which may be held detachably together.

Individual protective eyewear 12 from among the plurality of protective eyewear is exposed via the opening 10. In this example, the Individual protective eyewear 12 may comprise protective eyewear frames 14 attached to protective eyewear lenses 16, and the protective eyewear frames 14 may be folded with respect to the protective eyewear lenses 16, i.e., in a flat position.

Upon removal of the individual protective eyewear 12, a mechanism 20 may facilitate rotation between the protective eyewear frames 14 and the protective eyewear lenses 16 to prepare protective eyewear glasses 18. The mechanism 20 may include, for example, a compression force acting on the individual protective eyewear 12 within the interior volume of the dispenser 2 to prevent rotation, such as by weight of the plurality of protective eyewear, gravity and/or a spring pushing downward below top 8 of the dispenser 2, and limiting of the size of the opening 10 to allow rotation simultaneous with, or subsequent to, removal of the individual protective eyewear 12. Alternatively, a detent in the opening 10 may push the protective eyewear lenses 16 open as the individual protective eyewear 12 is pulled out of the dispenser 2. Alternatively, the protective eyewear lenses 16 may simply rest in closed position and may be manually opened after being dispensed. Traditional eyewear that may not be stored in a flat position may require larger containers.

Following removal of the individual protective eyewear 12, next individual protective eyewear from among the plurality of protective eyewear may then be exposed via the opening 10. In other words, as each eyewear component is removed from the storage container, the eye shield may flip vertically into normal position, and a next eyewear component may be presented.

In embodiments, the dispenser 2 may also be refilled with protective eyewear 12 from the sidewalls 6 or the top 8. Also, the dispenser 2 may be permanently installed on a wall, either directly or by a retaining mechanism. Also, protective eyewear may optionally include an RFID transponder 19, including as described below with respect to FIGS. 6A, 6B and 15.

Figure 2:
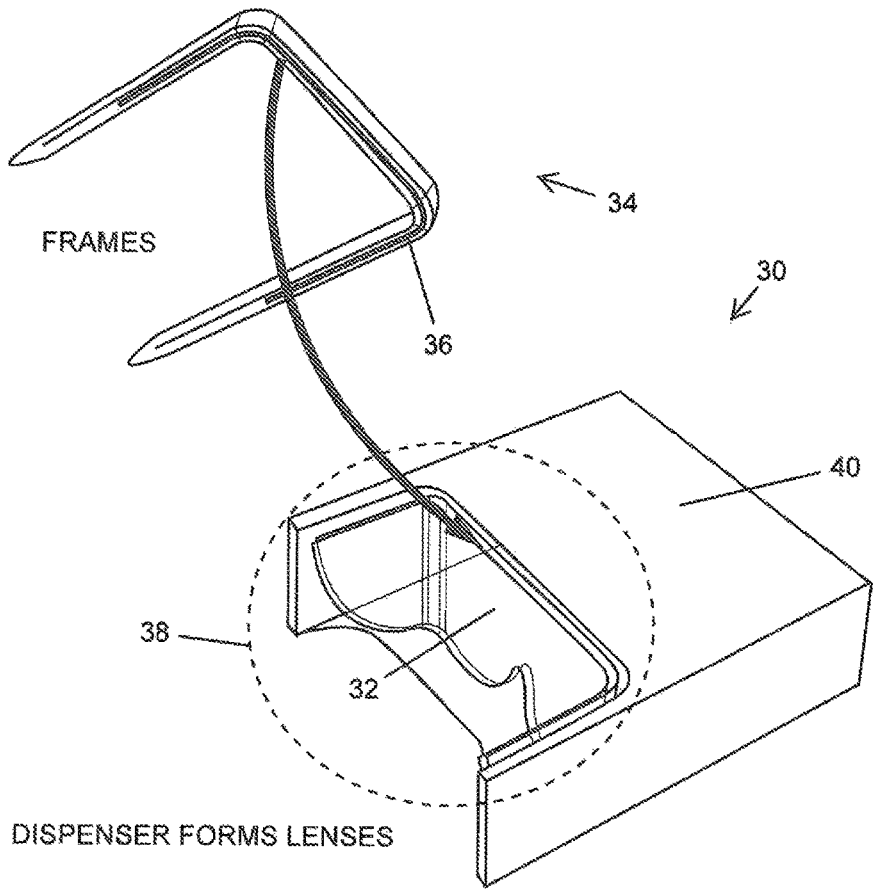
FIG. 2 illustrates a perspective view of a dispenser in which eye shields may be stored separate from the frame, and the frame may include a U-shaped channel that receives the eye shield, in accordance with an embodiment of the present invention.

Referring now to FIG. 2, a perspective view of a dispenser 30 in which eye shields or lenses 32 may be stored separate from frames 34 is provided in accordance with another embodiment of the present invention. In an embodiment, the frames 34 may include a U-shaped channel 36 that receives the eye shields 32. A mechanism, such as that described with respect to FIG. 1, may facilitate continuous placement of eye shields 32 in position via an opening 38, such that the frames 34 may be attached to exposed eye shields 32 to form protective eye glasses. Alternatively, the top 40 may be removed altogether to expose many eye shields 32. The frames 34 may attached to exposed eye shields 32, for example, be applying a force between the frames 34 and the eye shields 32 at the U-shaped channel 36. In other embodiments, alternative attachment possibilities may be provided, including via clips, detents, holes, adhesives, and so forth. The dispenser 30 may also be reused by restocking it with additional eye shields 32.

Figure 3:
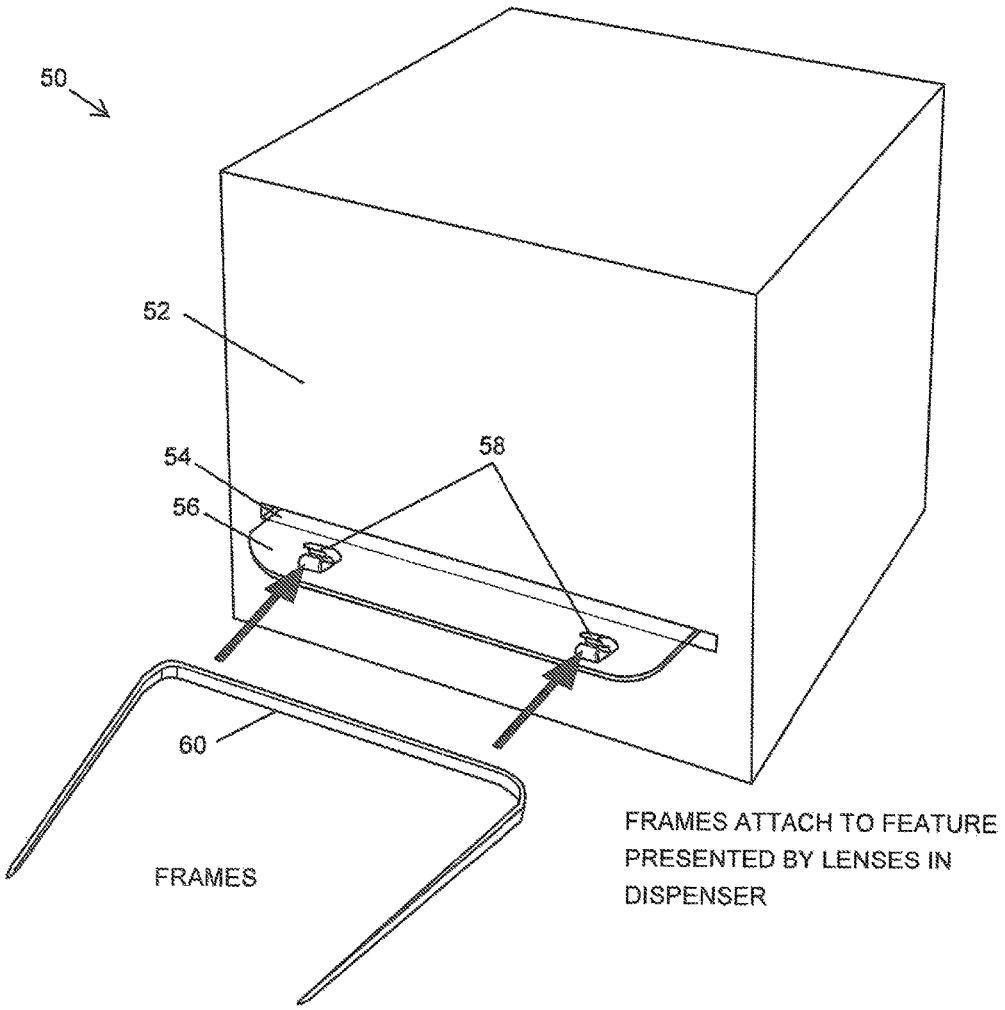
FIG. 3 illustrates a perspective view of a dispenser in which a small portion of an eye shield may be exposed allowing a user to push a frame into position to attach to attachment points on the eye shield and draw out the eye shield from the dispenser n accordance with an embodiment of the present invention.

Referring now to FIG. 3, a perspective view of a dispenser 50 is provided in accordance with another embodiment of the present invention. A front panel 52 of the dispenser 50 includes an opening 54 in which a portion of an eye shield 56 may be exposed. The portion of the exposed eye shield 56 may include a feature 58, such as a U-shaped channel, that allows a user to push frames 60 onto the feature 58 to attach the frames 60 to the eye shield 56 thereby forming protective eyewear glasses. Following attachment, the frames 60 may be used to draw the remaining portion of the protective eyewear glasses out of the dispenser 50. In alternative embodiments, the feature 58 may present holes that allow it to attach to the frames 60, as well as other possibilities, including clips, detents, adhesives, and so forth.

Figure 4:
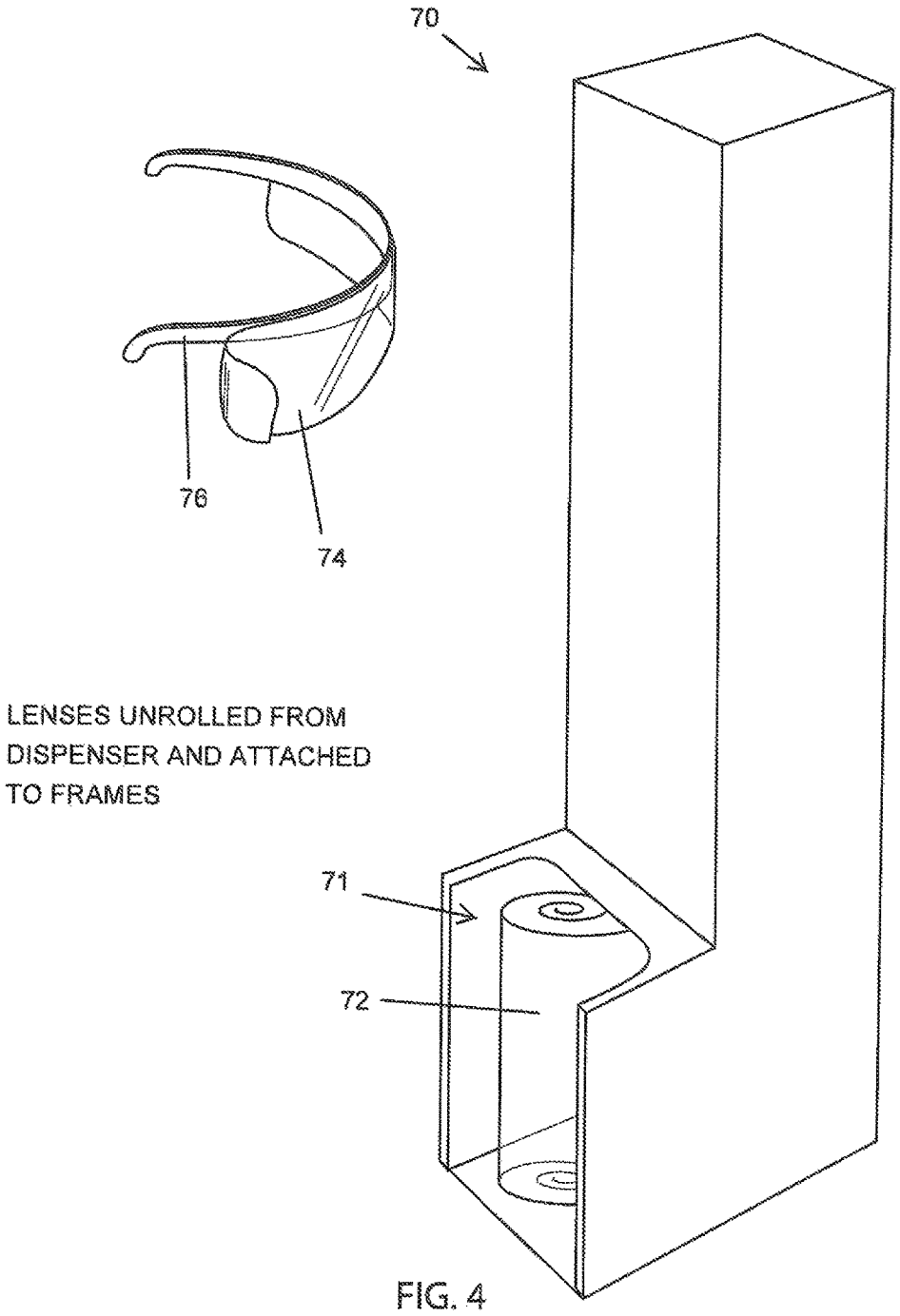
FIG. 4 illustrates a perspective view of a dispenser in which eye shields may be rolled up in accordance with an embodiment of the present invention.

Referring now to FIG. 4, a perspective view of a dispenser 70 with an opening 71 is provided in accordance with another embodiment of the present invention. A plurality of protective eyewear lenses may be held in the housing of the dispenser 70 as a roll 72. As each eye shield 74 is dispensed from the roll 72, the eye shield 74 may be attached to a frame 76. In embodiments, the roll 72 may also be sized to fit in a person's pocket for portability.

Figure 5:
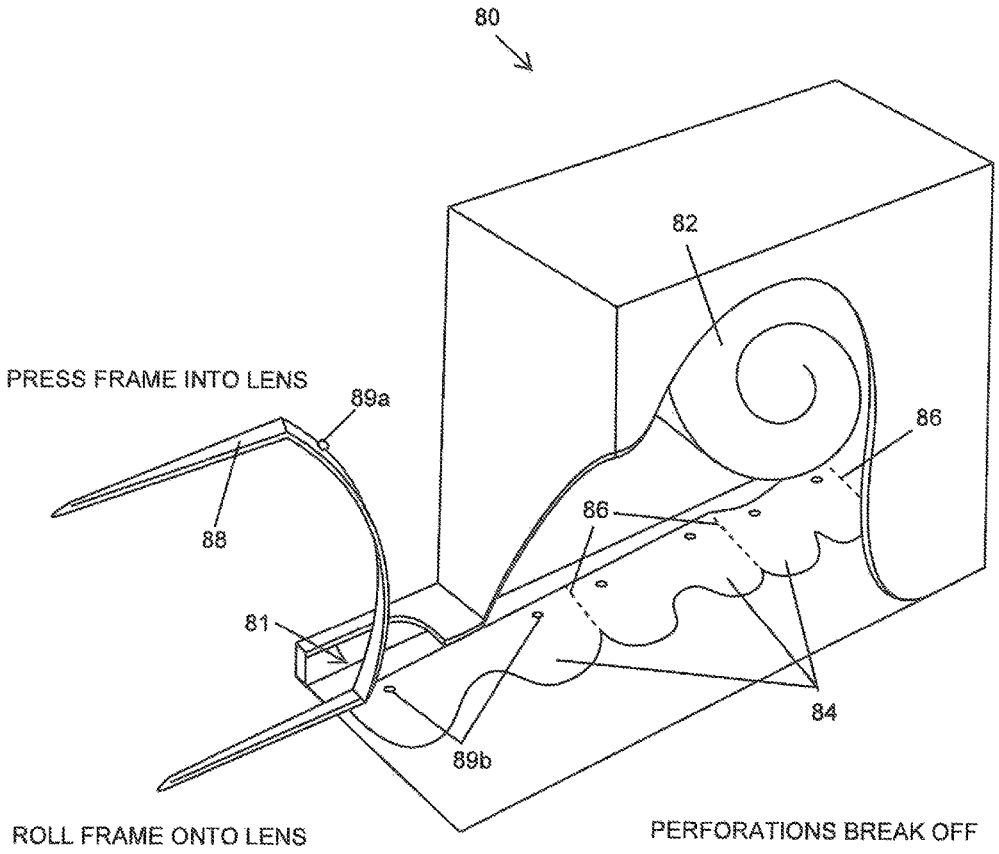
FIG. 5 illustrates a perspective view of a dispenser in which perforations allow a user to break off lenses from a roll as they are dispensed in accordance with an embodiment of the present invention.

Referring now to FIG. 5, a perspective view of a dispenser 80 with an opening 81 is provided in accordance with another embodiment of the present invention. The dispenser 80 includes a roll 82 of multiple eye shields 84. The roll 82 also includes perforations 86 between the eye shields 84 allowing a user to detachably break off one of the eye shields 84 one at a time from the roll 82 as the eye shields 84 are being dispensed. In operation, frames 88 may first be attached to the exposed eye shields 84 by pressing the frames 88 into the eye shields 84, such as by inserting a peg 89*a* on the frames 88 into a hole 89*b* in the eye shields 84. Next, the frames 88 may be rolled onto the eye shields 84 with one more additional pegs 89*a* on the frames 88 inserted into one more additional holes 89*b* in the eye shields 84. Finally, the perforations 86 may be broken, and next eye shields 84 may be exposed for dispensing.

Figure 6A:
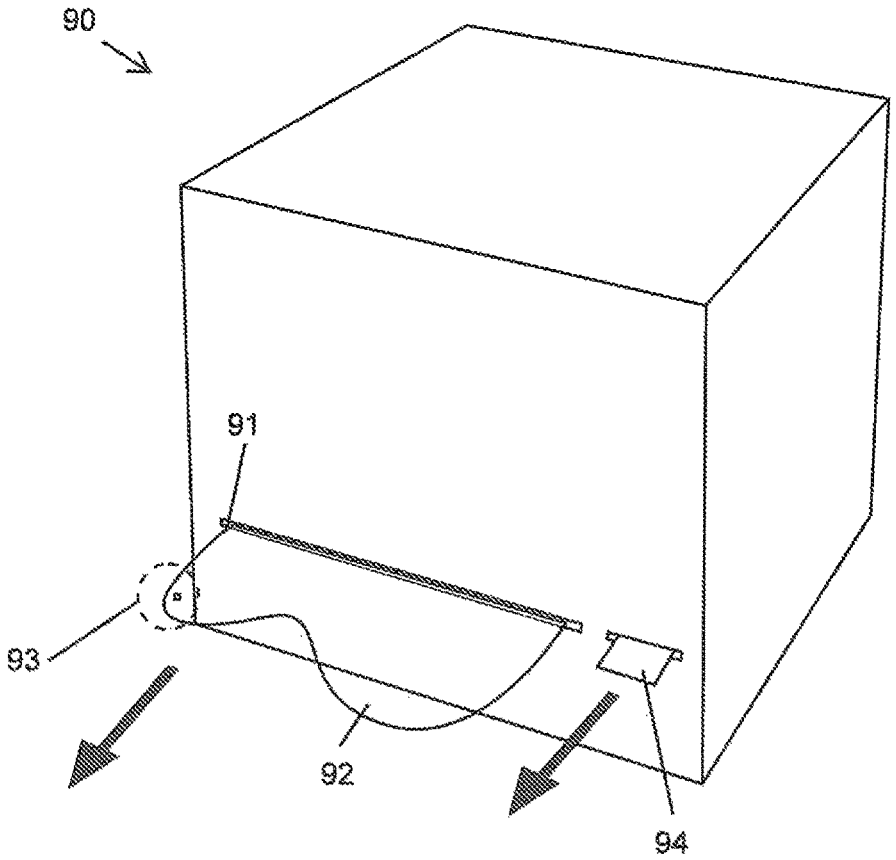
FIG. 6A illustrates a perspective view in which a common dispenser dispenses both eye protection and information or identification tags.

Referring now to FIG. 6A, a perspective view of a dispenser 90 with an opening 91 is provided in accordance with another embodiment of the present invention. The dispenser 90 may be a common dispenser for dispensing both eye protection 92, such as lenses, frames, or both, attached or otherwise, and an information or identification tag 94. In embodiments, the eye protection 92 may include an embedded RFID transponder 93 as described below with respect to FIG. 15.

Figure 6B:
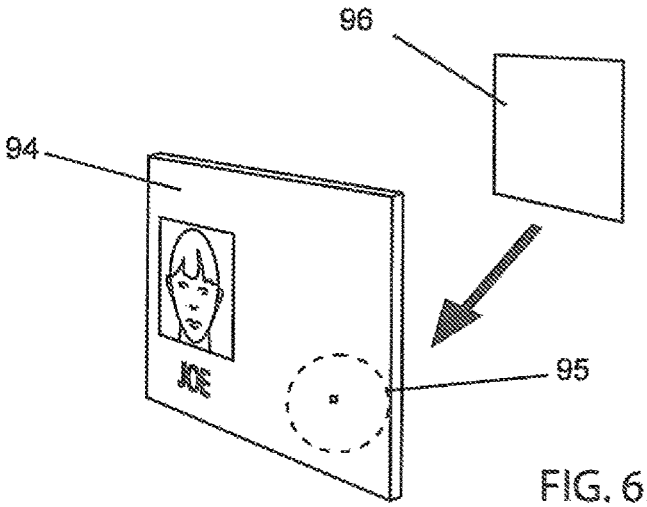
FIG. 6B illustrates adhesive information or identification tags, each in accordance with an embodiment of the present invention.

As shown in FIG. 6B, the tag 94 may provide a paper backing 96 which may be peeled away to expose an adhesive backing on the tag 94. The tag 94 may be used to identify a particular user or may be used to provide useful information, such instructions for the assembly of protective eyewear. In embodiments, the tag 94 may also include an embedded RFID transponder 95 as described below with respect to FIG. 15.

Reasons to use RFID tagging, such as the RFID transponder 93 or the RFID transponder 95, may include compliance and/or inventory management. Compliance management ensures, for example, that clinicians are confirmed as wearing protective eyewear. Inventory management ensures, for example, that products are tracked, and perhaps facilitate reordering, and may also be directed toward higher value products. In a preferred embodiment, RFID transponders may be embedded into or adhered onto protective eyewear frames, for example, during the manufacturing process.

With respect to inventory management, a sensor may also be provided, such as in the dispenser 90, which may sense the eyewear inventory level in the dispenser 90 and signal when the eyewear inventory level is low and requires restocking. This could be implemented with a single sensor, for example, and could obviate certain needs for RFID tagging.

Figure 7:
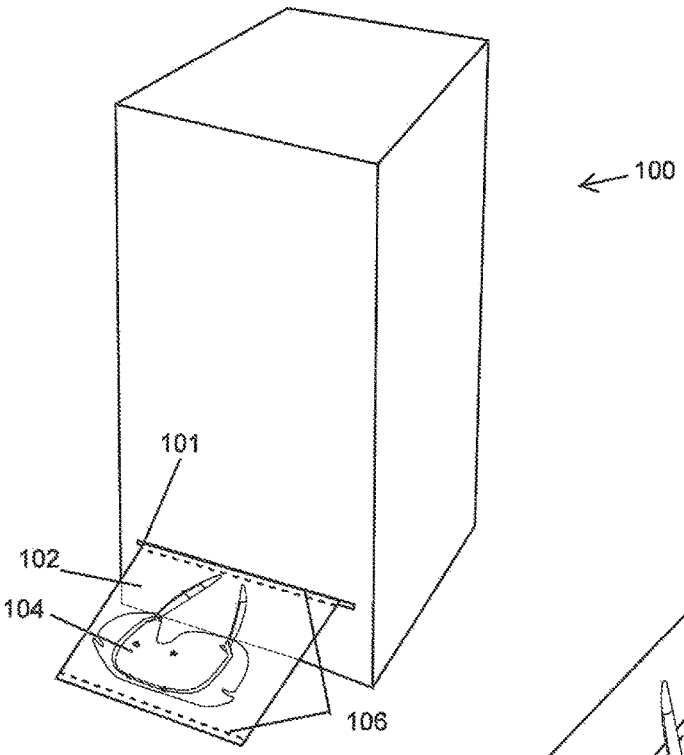
FIG. 7 illustrates a perspective view of a dispenser in which individual containers of eye protection may be provided in accordance with an embodiment of the present invention.

Referring now to FIG. 7, a perspective view of a vertical dispenser 100 with an opening 101 is provided in accordance with another embodiment of the present invention. The dispenser 100 may dispense individual containers 102 of eye protection 104 (lenses, frames or both) to a user. The containers 102 may also include perforations 106 between the containers 102 allowing a user to detachably break off one of the containers 102 from a bottom portion of the dispenser 100, one at a time, as the containers 102 are being dispensed.

Figure 8:
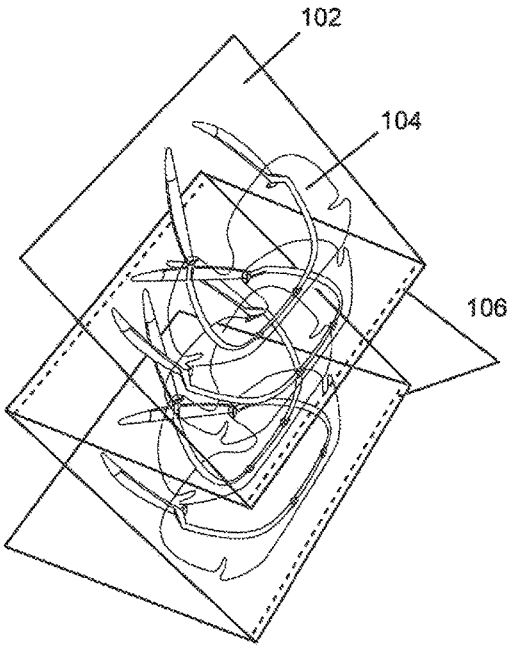
FIG. 8 illustrates a perspective view of a stacked serpentine configuration for eye protection in accordance with an embodiment of the present invention.

Turning briefly to FIG. 8, the containers 102, which may be individual bags, may be connected to another bag and folded on top of one another producing a stack of bags, each one containing eye protection. Accordingly, within the dispenser 100, a stacked serpentine configuration of the containers 102 may be provided.

Alternative embodiments may provide a stacked serpentine configuration without using containers 102, such as the protective eyewear lenses coupled by perforations in the embodiment of FIG. 5.

Figure 9:
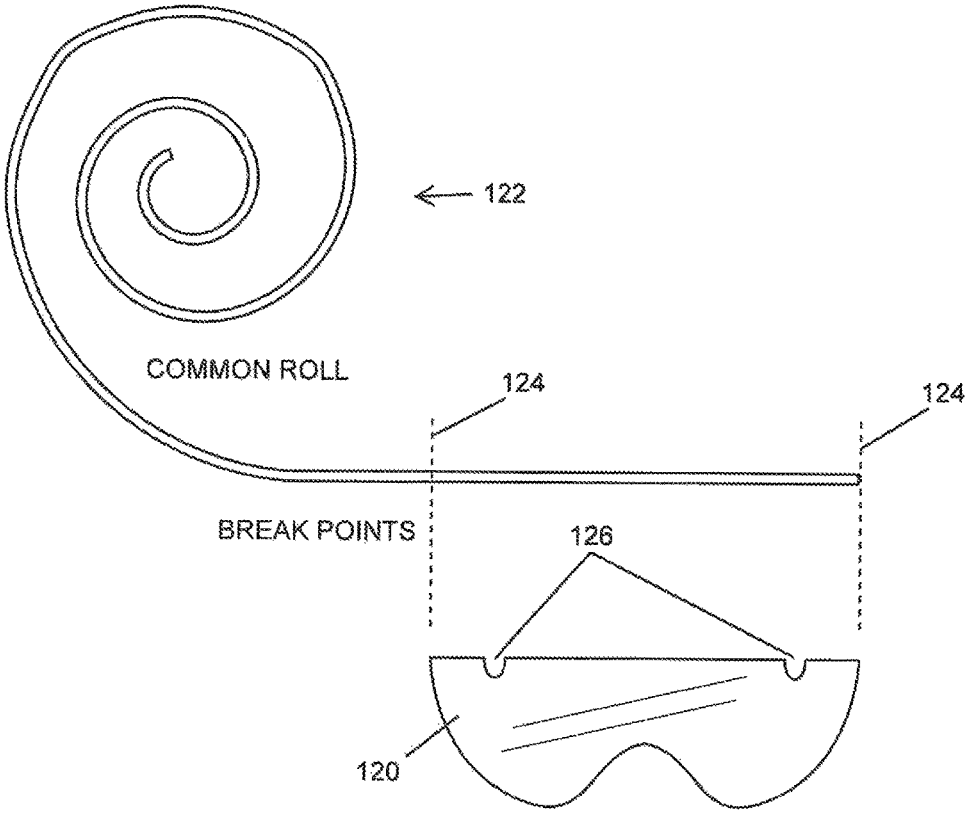
FIG. 9 illustrates multiple eye protection components on a common roll in accordance with an embodiment of the present invention.

Referring now to FIG. 9, in various embodiments of the present invention, multiple eye protection components 120 may be formed on a common roll 122. Accordingly, each eye protection component 120 may be detachably removed from a next eye protection component 120, such as via perforations 124. The common roll 122 may be advantageously sized to fit in a protective eyewear dispenser and/or a user's pocket. The eye protection component 120 may include notches 126, or other fastening points, for ease of assembly with protective eyewear frames. Also, the eye protection component 120 may be disposable.

Figure 10:
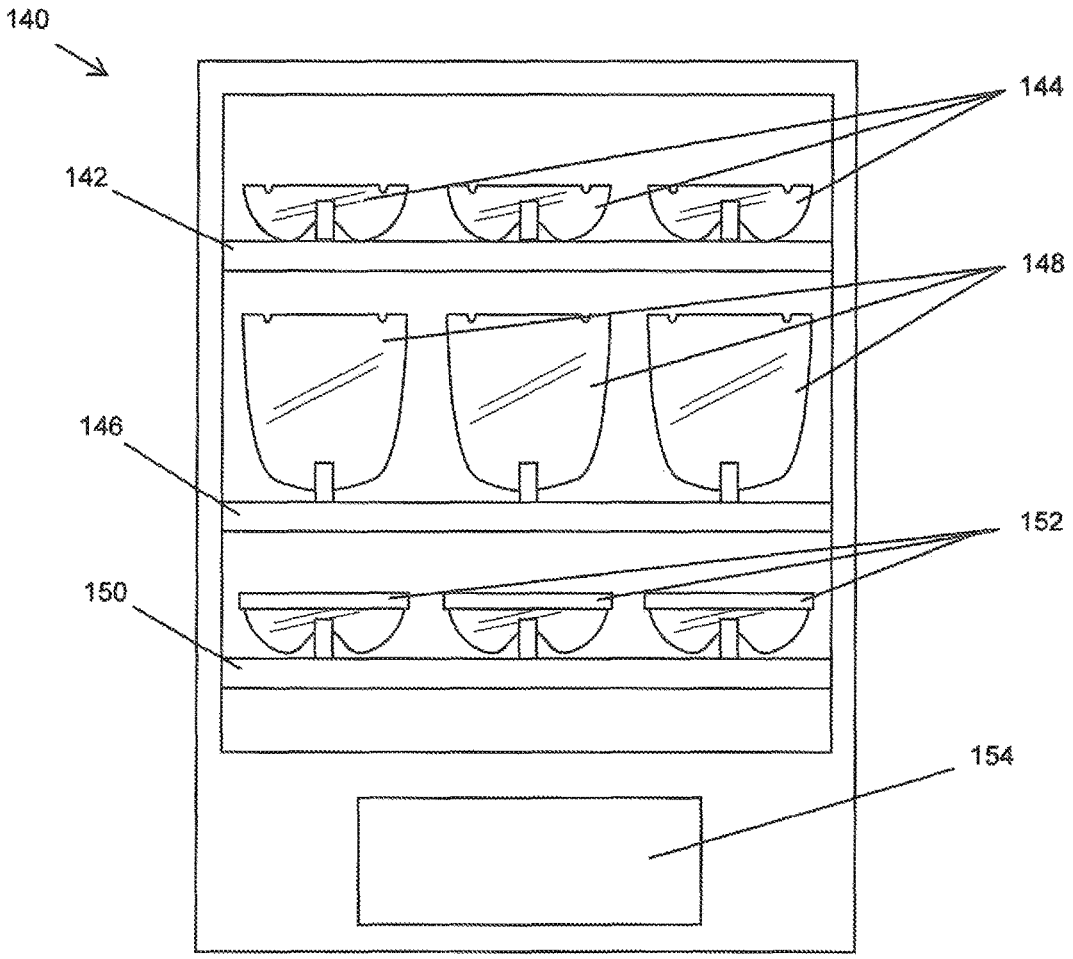
FIG. 10 illustrates a vending machine that may include many different types of eye protection, gowns, face masks, or any other component that is used in a hospital setting in accordance with an embodiment of the present invention.

Referring now to FIG. 10, a vending machine 140 may provide many different types of eye protection, gowns, face masks, or any other component that is used in a hospital setting in accordance with another embodiment of the present invention. In an embodiment, actuation of electronic buttons on a first row 142 may dispense corresponding components on the first row 142, such as disposable protective eyewear lenses 144; actuation of electronic buttons on a second row 146 may dispense corresponding components on the second row 146, such as face masks 148; and so forth. Selected components may be dispensed via opening 154. In addition, the vending machine 140 may implement network and control systems for electronically tracking and reporting, for example, particular items dispensed, users to whom items are dispensed, inventory statuses, and so forth.

Figure 11:
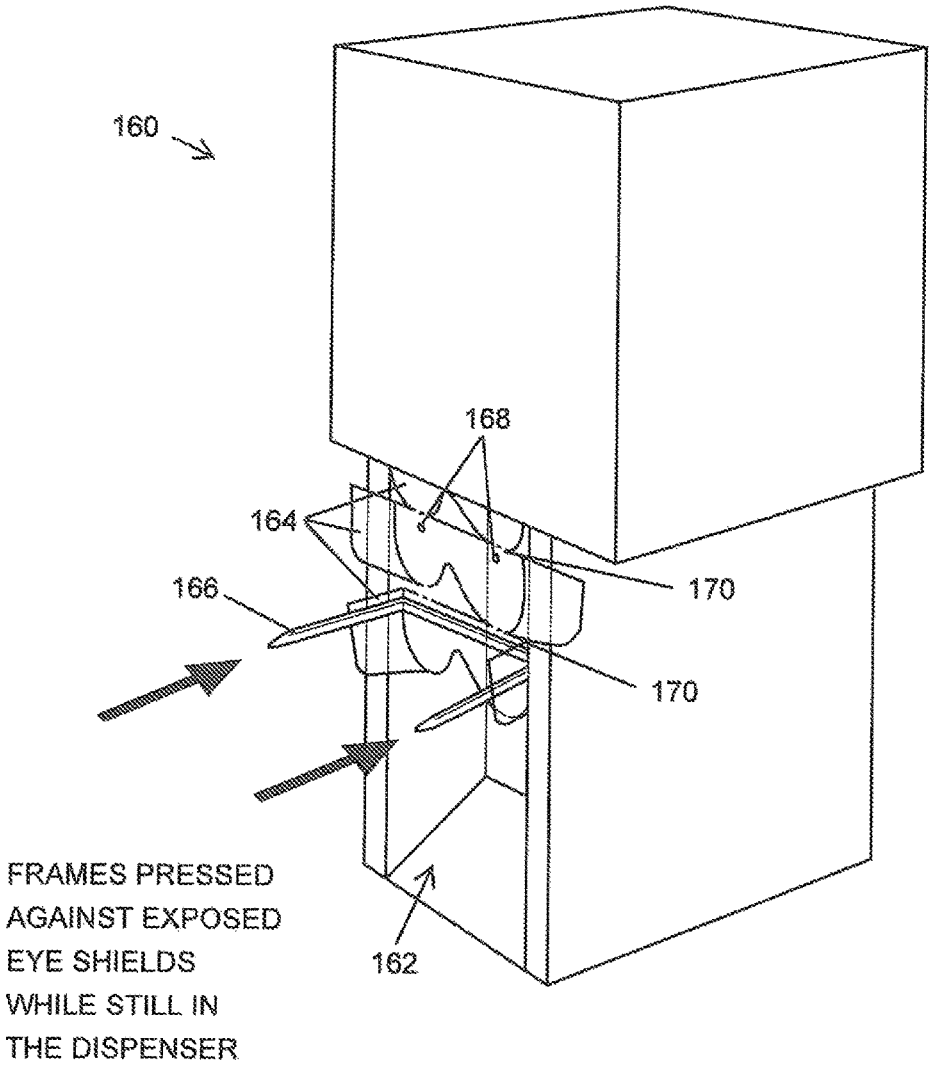
FIG. 11 illustrates a perspective view of a dispenser in which a frame may be pressed against the eye shield while the eye shield is still in the dispenser in accordance with an embodiment of the present invention.

Referring now to FIG. 11, a perspective view of a dispenser 160 is provided in accordance with another embodiment of the present invention. The dispenser 160 provides an opening 162 in which eye shields 164 held in the interior of the dispenser 160 may be exposed and dispensed one at a time. The opening 162 is sized and configured such that frames 166 may be pressed against exposed eye shields 164 while the exposed eye shields 164 are still in the dispenser. By pressing the frames 166 against the exposed eye shields 164, such as via attachment points 168, protective eyewear glasses may be quickly assembled while the eye shields 164 are still in the dispenser 160. In addition, the exposed eye shields 164 may be detachably removed from a adjacent next eye shields, such as on a roll, via perforations 170.

Figure 12:
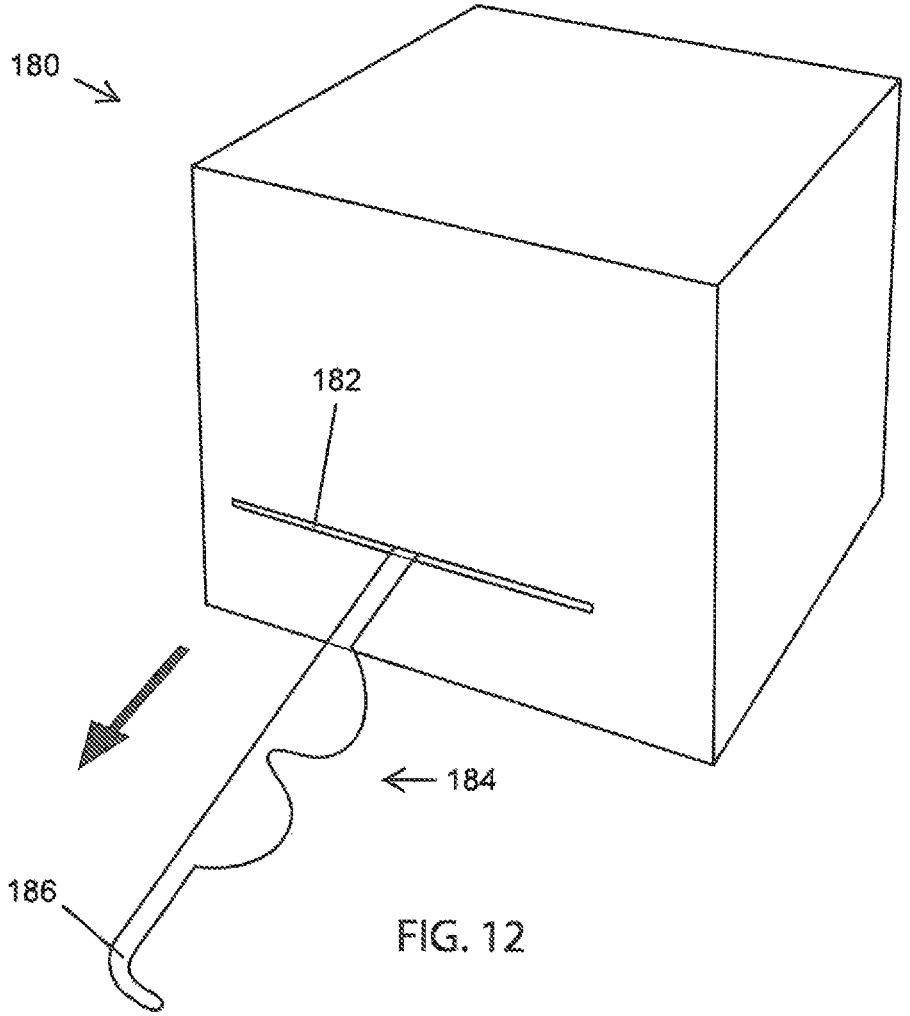
FIG. 12 illustrates a perspective view of a dispenser in which eye protection may be made of a flexible material and does not include a frame in accordance with an embodiment of the present invention.

Referring now to FIG. 12, a perspective view of a dispenser 180 is provided in accordance with another embodiment of the present invention. The dispenser 180 dispenses, via an opening 182, eye protection 184 which may be made of a flexible material, such as a film, and does not include a frame. The eye protection 184 includes side portions 186 with cutouts designed to attach to a person's ears. The eye protection 184 may be stored within the dispenser 180 in various arrangements, including a roll or a stacked serpentine. Also, various mechanisms may be used for dispensing the eye protection 184, including pulling an exposed portion of the eye protection 184 on a roll and detaching the eye protection 184 from a next eye protection, such as via perforations, and thereby leaving next eye protection at least partially exposed.

In embodiments, a roll of the eye protection 184 may also be sized to fit in a person's pocket. Since there is no frame and the eye protection 184 may be flexible, portability may be achieved.

Figure 13A:
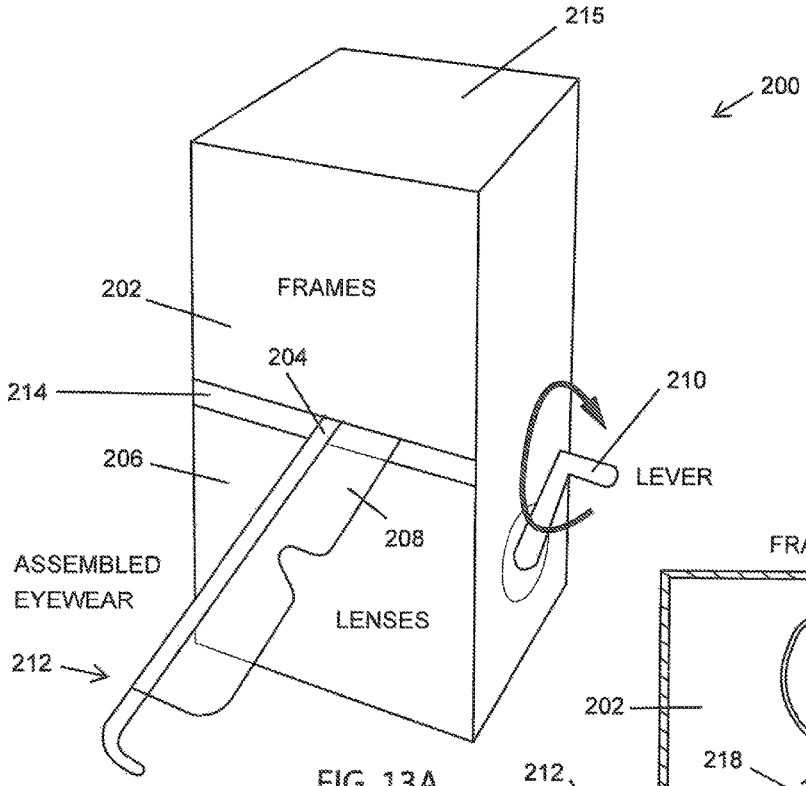
FIG. 13A illustrates a perspective view of a dispenser in which a lever or other mechanism may be provided for allowing the dispenser to dispense assembled eye protection.

Referring now to FIG. 13A, a perspective view of a dispenser 200 is provided in accordance with another embodiment of the present invention. The dispenser 200 includes a first housing portion 202, which may house a first component 204 for eye protection, such as frames, and a second housing portion 206, which may house a second component 208 for eye protection, such lenses. Actuation of a lever or other mechanism 210 facilitates assembly of the first component 204 with the second component 208 to produce assembled eye protection 212. The assembled eye protection 212 is provided to a user via an opening 214.

The lever 210 may be in mechanical communication with the first and second components for providing internal assembly, such as via direct connection to belts, gears and so forth, and dispensing. Alternatively, the lever 210 may be in electronic communication with a controller which internally actuates machinery in communication with the first and second components for internal assembly and dispensing. Alternative embodiments may also provide additional components as part of the assembly. In addition, one or more feed points 215 may be provided for feeding various eyewear components for the internal assembly.

Figure 13B:
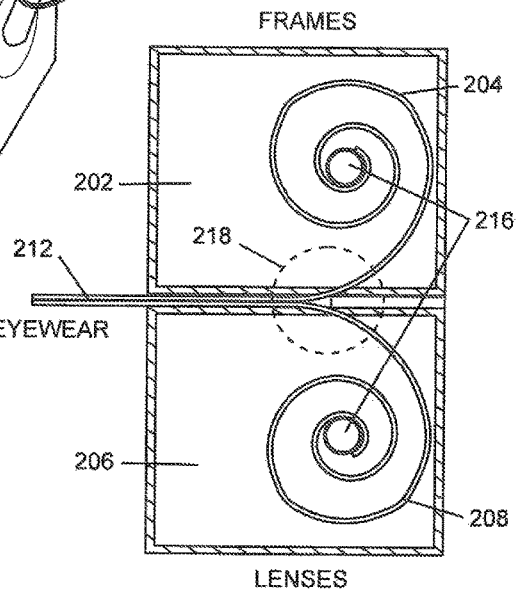
FIG. 13B illustrates a schematic view of the dispenser, each in accordance with an embodiment of the present invention.

FIG. 13B illustrates an exemplar schematic view of the dispenser 200 in accordance with an embodiment of the present invention. Actuation of the lever 210 facilitates motion of the first component 204, which may be a roll of frames, and the second component 208, which may be a roll of lenses, via gears 216 and feed, alignment and press 218.

Figure 14A:
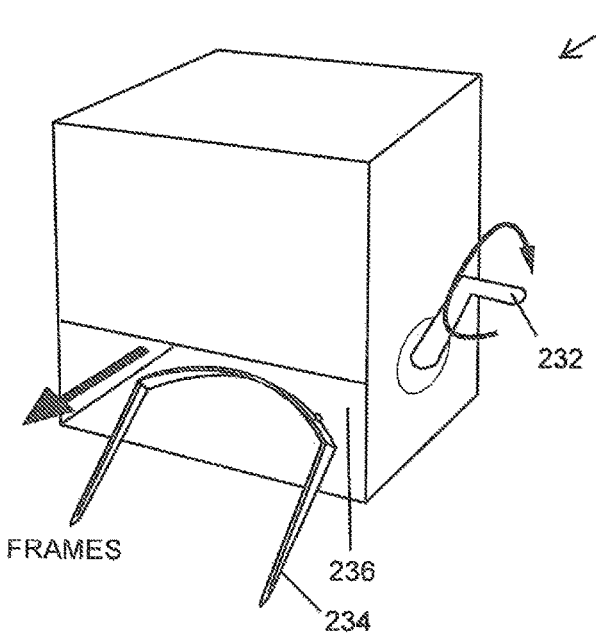
FIG. 14A illustrates a perspective view of a dispenser in which a lever or other mechanism may be provided for allowing the dispenser to dispense eyewear components.
Figure 14B:
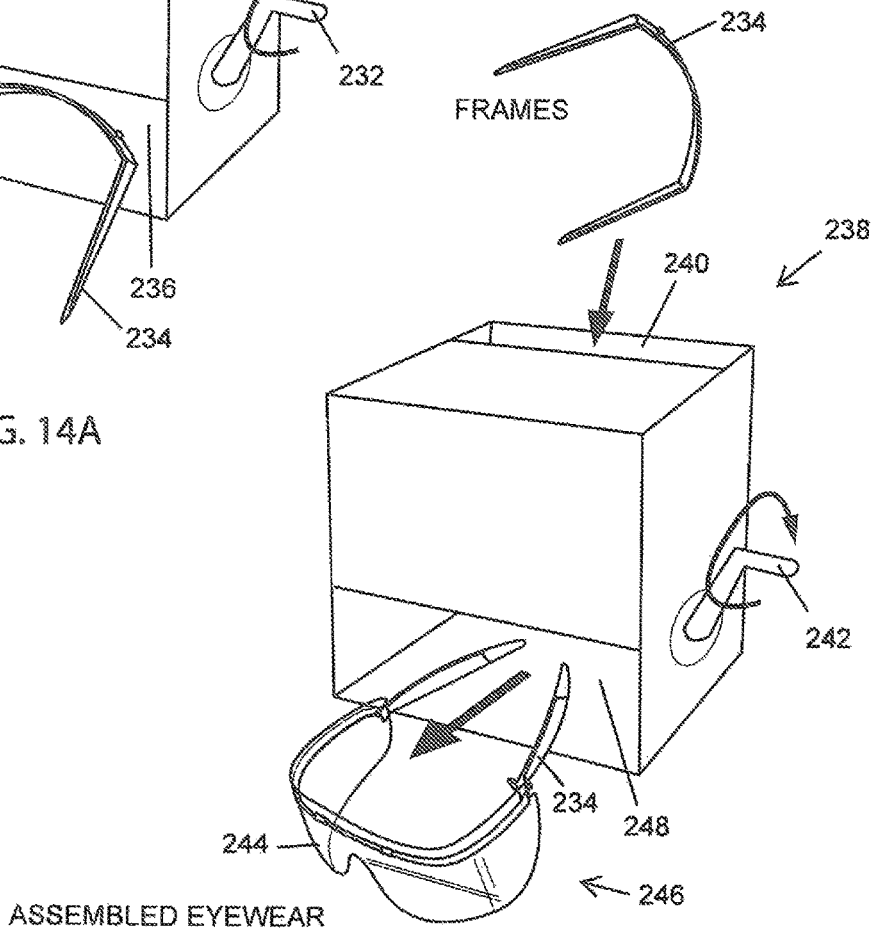
FIG. 14B illustrates a perspective view of a dispenser in which a lever or other mechanism may be provided for receiving an eyewear component, and assembling and dispensing eye protection, each in accordance with an embodiment of the present invention.

Referring now to FIG. 14A, a perspective view of a first dispenser 230 is provided in accordance with another embodiment of the present invention. The first dispenser 230 may include a lever or other mechanism 232 which may be actuated to dispense a first eyewear component 234, such as a single pair of frames, via an opening 236. Turning to FIG. 14B, the first eyewear component 234 may then be inserted into a second dispenser 238 via an insertion point 240. The second dispenser 238 may also include a lever or other mechanism 242 which may be actuated to assemble together the first eyewear component 234 and a second eyewear component 244, such as a single pair of lenses, to form protective eyewear glasses 246 which may be dispensed via an opening 248.

In other words, the second dispenser 238 may attach an eye shield to a frame automatically when the second dispenser 238 is activated. Alternatively, previously used frames may be inserted into the second dispenser 238 to attach to a new pair of lenses, as opposed to obtaining new frames from the first dispenser 230.

Figure 15:
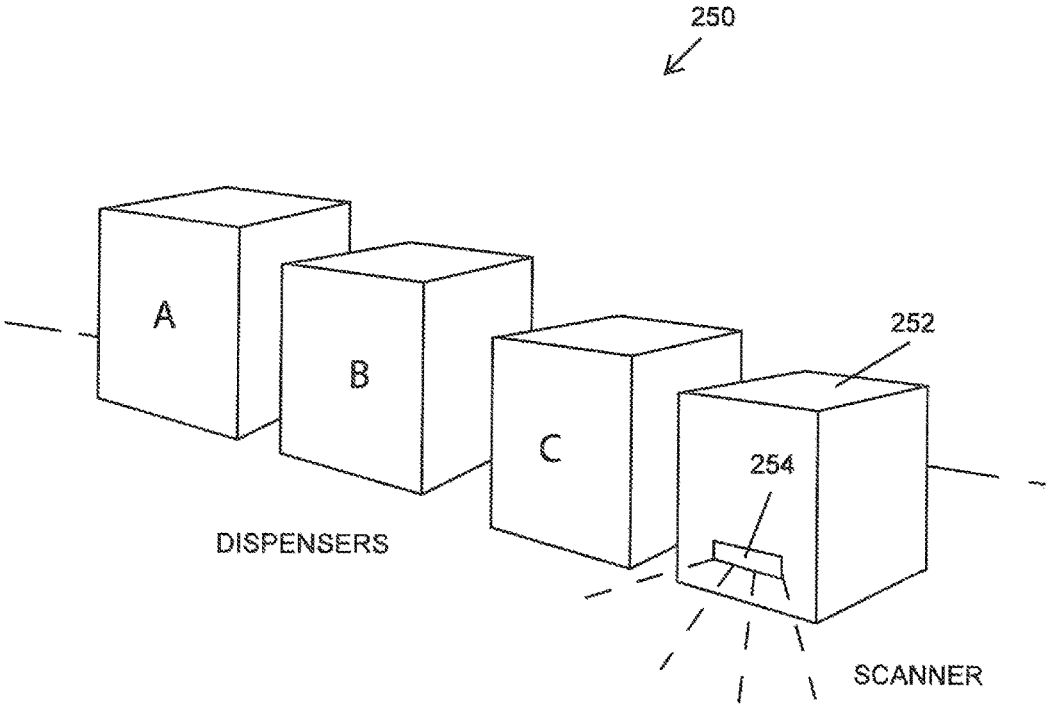
FIG. 15 illustrates a perspective view of dispensing devices and a scanner to track the dispensing of products in accordance with an embodiment of the present invention.

Referring now to FIG. 15, in a dispensing system 250, multiple dispensing devices "A," "B" and "C" may be located in proximity to a scanner 252 to track the dispensing of various products in accordance with an embodiment of the present invention. The multiple dispensing devices "A," "B" and "C" may dispense a wide variety of medical related products, such as frames, lenses, protective eye glasses, face masks, face shields, gloves, towels, and so forth. A scanning element 254, such as a Radio Frequency Identification ("RF-ID") transceiver or Infrared sensor, may scan individually dispensed products and/or users in proximity to individually dispensed products. Dispensed products may include, for example, an RFID transponder having unique and/or grouped identification code(s), and users in proximity may carry, for example, an identification badge with an RFID transponder also having unique and/or grouped identification code(s). The scanner 252 may internally store scanned information, which may be used, for example, to facilitate product reordering, or may provide periodic or continuous feedback to a remote computer or server.

In addition, a controller in the scanner 252 may be used to communicate via a wired or wireless network connecting the multiple dispensing devices "A," "B" and "C." Accordingly, the scanning element 254 may scan with knowledge of activity occurring at the multiple dispensing devices "A," "B" and "C."

In embodiments, products may also be purchased with a receipt given which indicates the individual components purchased with an indicia, such as color. A person may then identify the dispensing devices "A," "B" and "C" and/or component with a matching indicia.

Figure 16:
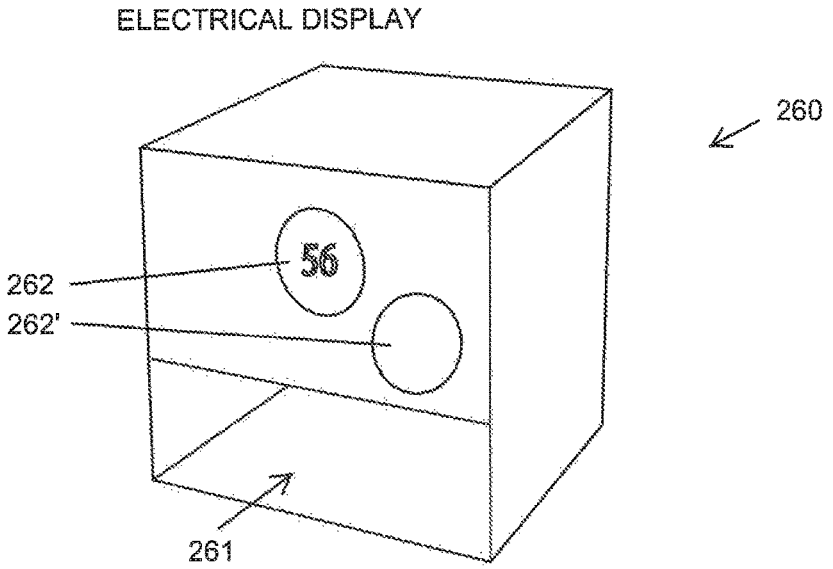
FIG. 16 illustrates a perspective view of dispensing device with an electrical display in accordance with an embodiment of the present invention.

Referring now to FIG. 16, a perspective view of a dispenser 260 with an opening 261 is provided in accordance with another embodiment of the present invention. The dispenser 260 includes an electrical display 262, such as a Liquid Crystal Display ("LCD") or Light Emitting Diode ("LED") display. The electrical display 262 may also be in communication with a controller and/or sensors within the dispenser 260.

Accordingly, the electrical display 262 could display, for example, to: 1) inform users of the infection prevention caution level for their specific department, procedure area, or patient; 2) provide educational messages; 3) track compliance; and/or 4) provide a count of how many components remain in the dispenser, such as protective eyewear lenses, frames, glasses, and so forth, to facilitate reordering; 5) provide instructions for using the components; 6) provide contact or help information; 6) provide advertisements; 7) recommend components that supplement what is being dispensed; 8) and/or provide any other advantageous information. The electrical display 262 may also be interactive, such as via touch screen. In embodiments, multiple electrical displays could be provided on a single dispenser, such as electrical display 262 and electrical display 262', and/or multiple screens may be provided on a single electrical display, to accomplish one or more of the above objectives.

With respect to tracking compliance, a sensor in the dispenser could further sense when a user removes a pair of eyewear, and/or the user may be required to register or tap the electrical display 262 to indicate compliance. This method of compliance tracking could obviate certain needs for RFID tagging as described above with respect to FIGS. 6A and 6B.

Figure 17:
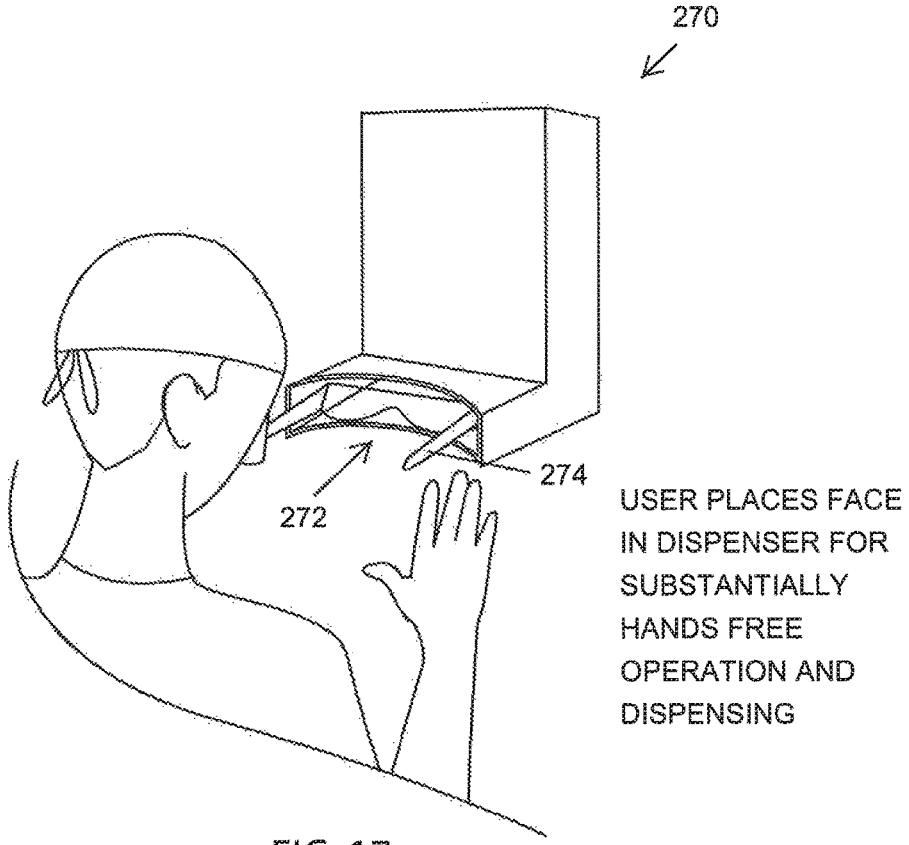
FIG. 17 illustrates a perspective view of dispensing device in which a user may press their face against the dispenser and eye protection may be dispensed onto the user's face in accordance with an embodiment of the present invention.
Figure 18:
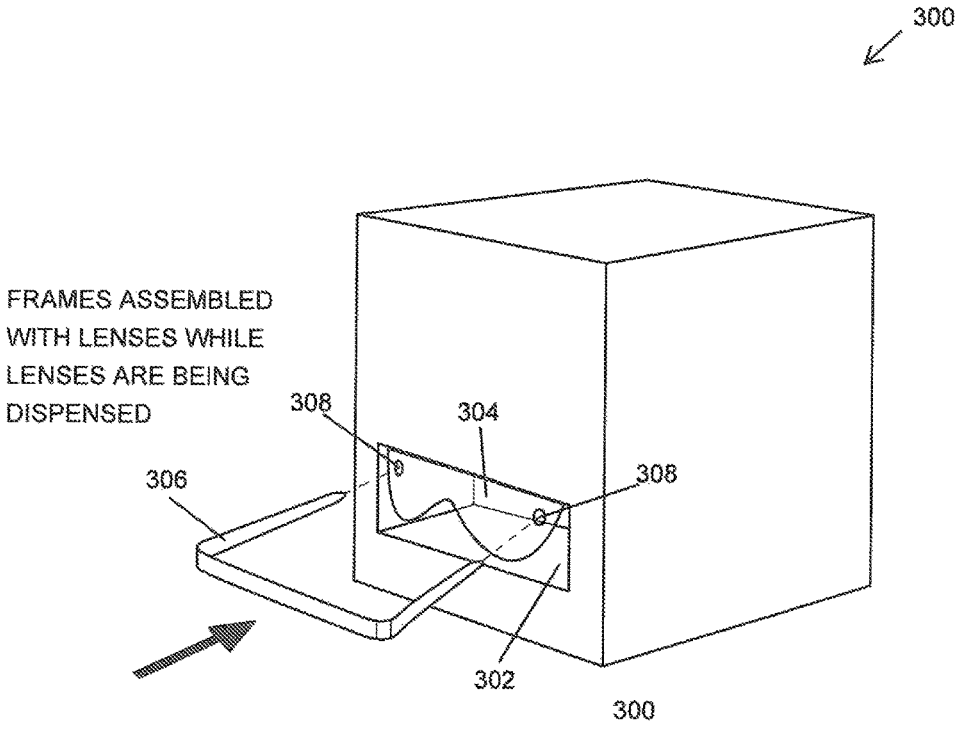
FIG. 18 illustrates a perspective view of dispensing device in which a frame may be pushed through a series of holes in an eye shield attaching the frame to the eye shield in accordance with an embodiment of the present invention.

Referring now to FIG. 17, a perspective view of a dispenser 270 is provided in accordance with another embodiment of the present invention. The dispenser 270 provides an opening 272 which provides ease of dispensing protective eyewear 274 with substantially hands free operation. The opening 272 is sized and configured such that a user may position their face against the opening 272 to securely dispense the protective eyewear 274 onto the user's face. Upon removal of the protective eyewear 274 and the user's face, the dispenser 270 may dispense a next protective eyewear 274.P Referring now to FIG. 18, a perspective view of a dispenser 300 is provided in accordance with another embodiment of the present invention. The dispenser 300 provides an opening 302 which exposes individual protective eyewear lenses 304. The opening 302 is sized and configured such that frames 306 may be attached to the protective eyewear lenses 304, such as by pushing the frames 306 through a series of holes 308 in the protective eyewear lenses 304, while the protective eyewear lenses 304 are still in the dispenser 300. Accordingly, assembled protective eyewear glasses may then be removed from the dispenser 300, such as by detachably removing the protective eyewear lenses 304 via perforations to expose next protective eyewear lenses.

There are virtually innumerable uses for the present invention, all of which need not be detailed here. All the disclosed embodiments can be practiced without undue experimentation.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

It should be appreciated that the individual components need not be formed in the disclosed shapes, or assembled in the disclosed configuration, but could be provided in virtually any shape and assembled in virtually any configuration. For example, dispenser according to several embodiments of the invention may dispense lenses, frames and/or combined lenses and frames, despite exemplifying dispensing of one or the other. Further, although various embodiments of eye protection, face shields, head bands, etc. are described herein with certain features, any of the features may be combined with or removed from any of the embodiments. Furthermore, all the disclosed features of each dispenser may be combined with, or substituted for, the disclosed features of every other embodiment.

It is intended that the appended claims cover all such additions, modifications, and rearrangements. Expedient embodiments of the present invention are differentiated by the appended claims.

What is claimed is:

1. A dispenser for protective eyewear, the protective eyewear including frames attached to lenses, the dispenser comprising:

a plurality of protective eyewear, wherein the frames of the protective eyewear are folded with respect to the lenses of the protective eyewear in a flat position, and wherein each of the plurality of protective eyewear is unpackaged;

a housing having a front panel and sidewalls defining an interior volume configured to hold the plurality of protective eyewear;

an opening positioned in a lower portion of the front panel, wherein individual protective eyewear from among the plurality of protective eyewear are exposed by the opening in the front panel, and next individual protective eyewear from among the plurality of protective eyewear are arranged in the housing to be fed downward to be exposed by the opening in the front panel upon removing the individual protective eyewear from the opening; and a mechanism in the opening configured to engage the lenses of the individual protective eyewear upon removal from the opening, wherein the size of the opening is limited to require contact between the mechanism and individual protective eyewear upon removal of the individual protective eyewear so that removal of the individual protective eyewear through the opening causes the mechanism to provide rotation between the frames and the lenses of the individual protective eyewear to flip the individual protective eyewear into a normal position as the individual protective eyewear is moved through the opening to prepare the individual protective eyewear for use upon removal from the opening.

2. The dispenser of claim 1, further comprising a scanner coupled to the dispenser that is configured to wirelessly scan at least one of user identification and dispensed protective eyewear lenses.

3. The dispenser of claim 1, further comprising an adhesive information tag dispensed with each of the plurality of protective eyewear lenses.

4. The dispenser of claim 1, wherein the mechanism is a detent in the opening operable to push the lenses open as the individual protective eyewear is removed from the opening.

5. The dispenser of claim 1, wherein each of the plurality of the protective eyewear further includes a Radio Frequency Identification (RFID) transponder.

6. The dispenser of claim 1, further comprising an electrical display coupled to the dispenser that is configured to convey a count of protective eyewear in the dispenser.

7. The dispenser of claim 1, further comprising an electrical display coupled to the dispenser that is configured to convey instructions for using the protective eyewear.

8. The dispenser of claim 1, further comprising an electrical display coupled to the dispenser that is configured to convey a caution level for a predetermined area.

9. The dispenser of claim 1, further comprising an electrical display coupled to the dispenser that is configured to convey contact or help information.

10. The dispenser of claim 1, further comprising an electrical display coupled to the dispenser that is configured to convey advertisements.

11. A dispenser for protective eyewear, the protective eyewear including frames attached to lenses, the dispenser comprising:

a plurality of protective eyewear, wherein the frames of the protective eyewear are folded with respect to the lenses of the protective eyewear in a flat position, and wherein each of the plurality of protective eyewear is unpackaged;

a housing having a front panel and sidewalls defining an interior volume configured to hold the plurality of protective eyewear;

an opening in the front panel, wherein individual protective eyewear from among the plurality of protective eyewear are exposed by the opening in the front panel, and next individual protective eyewear from among the plurality of protective eyewear are exposed by the opening in the front panel upon removing the individual protective eyewear from the opening;

a detent in the opening configured to engage the lenses of the individual protective eyewear upon removal from the opening, wherein size of the opening is limited to require contact between the detent and individual protective eyewear upon removal of the individual protective eyewear so that removal of the individual protective eyewear through the opening causes the detent to provide rotation between the frames and the lenses of the individual protective eyewear to flip the individual protective eyewear into a normal position as the individual protective eyewear is moved through the opening to prepare the individual protective eyewear for use upon removal from the opening; and at least two electrical displays coupled to the dispenser, the at least two electrical displays each being configured to convey information different from one another.

12. The dispenser of claim 11, wherein at least one electrical display of the at least two electrical displays is a touch screen.

13. The dispenser of claim 11, wherein each of the plurality of protective eyewear further includes a Radio Frequency Identification (RFID) transponder.

* * * * *